United States Patent [19]

Sato et al.

[11] Patent Number: 4,832,890

[45] Date of Patent: May 23, 1989

[54] CASTING PROCESS

[75] Inventors: Kimiteru Sato; Haruyuki Ito, both of Kitakyushu, Japan

[73] Assignee: Toto Ltd., Kitakyushu, Japan

[21] Appl. No.: 81,846

[22] Filed: Aug. 5, 1987

[30] Foreign Application Priority Data

Aug. 8, 1986 [JP] Japan ..... 61-186242

[51] Int. Cl.[4] ..... B28B 1/26; B28B 21/08; B28B 21/36

[52] U.S. Cl. ..... 264/87; 425/85

[58] Field of Search ..... 269/86, 87, 517, 570, 269/333; 425/84–86

[56] References Cited

U.S. PATENT DOCUMENTS

| | | | |
|---|---|---|---|
| 1,336,180 | 4/1920 | Allen et al. | 264/87 |
| 1,340,308 | 5/1920 | Williams | 264/87 |
| 2,584,109 | 2/1952 | Blackburn et al. | 264/86 |
| 3,156,451 | 11/1964 | Valdes et al. | 264/87 X |
| 3,243,860 | 4/1966 | Whittaker et al. | 25/129 |
| 3,431,332 | 3/1969 | Cummings | 264/86 |
| 3,659,994 | 5/1972 | Ehrlich | 264/87 X |
| 3,993,727 | 11/1976 | Skriletz et al. | 264/87 X |
| 4,043,737 | 8/1977 | Greenberg | 425/450.1 X |
| 4,413,966 | 11/1983 | Mills et al. | 264/225 |
| 4,528,152 | 7/1985 | Aoyama et al. | 264/87 |
| 4,591,472 | 5/1986 | Gerster | 264/87 |

FOREIGN PATENT DOCUMENTS

| | | | |
|---|---|---|---|
| 0211653 | 2/1987 | European Pat. Off. | 264/87 |
| 58-17811 | 4/1963 | Japan . | |
| 56-14451 | 4/1981 | Japan . | |
| 58-208005 | 12/1983 | Japan . | |
| 60-8010 | 1/1985 | Japan . | |
| 1295055 | 11/1972 | United Kingdom . | |

*Primary Examiner*—Jan H. Silbaugh
*Assistant Examiner*—Karen D. Kutach
*Attorney, Agent, or Firm*—Fleit, Jacobson, Cohn & Price

[57] ABSTRACT

A process for casting slip into a ceramic product using at least one unique casting mold. The casting mold is formed of a plurality of separate porous mold parts, each of which has a fluid-tight outer face, an inner molding surface and a plurality of channels therein. The mold parts are combined so that the inner molding surfaces define a molding cavity in the mold. The casting mold is positioned within a pressure container such that a space is established surrounding the casting mold within the pressure container. This space is in fluid communication with the molding cavity of the mold. The casting process further includes the steps of: sealing the pressure container; firmly clamping the casting mold; feeding slip under a first pressure into the molding cavity until the molding cavity is filled with slip; supplying a fluid under a second pressure higher than the first pressure into the space surrounding the casting mold thereby applying the second pressure to the slip in the molding cavity and to the inner molding surfaces of the mold parts to form a cast layer of a predetermined thickness within the molding cavity; depressurizing the channels to drain water accumulated therein; discharging residual slip from the molding cavity; and removing the casting mold from the pressure container.

10 Claims, 4 Drawing Sheets

CASTING PROCESS

BACKGROUND OF THE INVENTION

1. Field of the Invention

The present invention relates to process for casting slip into ceramic products such as sanitaryware, water tanks, tiles, porcelain plates and pipes, gravestones or the like.

2. Description of the Prior Art

In the prior art slip casting process, slip is introduced under a pressure in the range of 3 to 20 kg/cm$^2$ into a pressure-resisting porous casting mold so that the water content of the slip may be extruded under the action of that pressure through the interface between the inner molding surface of the mold and the slip, via the thickness of the porous mold and eventually to the outside of the mold. This casting operation is continued until the slip in the region of the molding surface is dehydrated to deposit into a layer of a predetermined thickness. On attaining the predetermined thickness of the cast slip layer on the interior surface of the casting mold, the casting mold is rotated or inclined while being fed with compressed air (under a pressure within the range of about 1 to 2 kg/cm$^2$) for forcibly discharging the residual slip out of the mold via a slip discharge port in the mold. After this discharging, the discharge port is closed, and additional compressed air is fed into the mold to provide further dehydration or reduction in the water content of the slip cast layer.

The main disadvantage of the prior slip casting techniques is that the casting mold requires high pressure resistance sufficient to withstand the relatively high pressure under which the slip is being introduced thereinto, which can result in costly and time-consuming production of the casting mold.

Furthermore, the casting installation as well must be durable and heavy, which would degrade its profitability.

SUMMARY OF THE INVENTION

With the defects of the prior art technique in mind, therefore, an object of the present invention is to provide a process for efficiently casting the slip into a ceramic product by use of a unique lightweight casting mold as is easy to handle but need not have a highly durable pressure-resisting structure.

According to important aspect of the present invention, there is provided a process for casting slip into a ceramic product comprising the steps of:

providing at least one casting mold, the casting mold being formed of a plurality of porous mold parts each having a plurality of channels therein and having its respective outer face treated to be fluid-tight and having an inner molding surface, the mold parts being combined to define a molding cavity in the mold;

locating said at least one casting mold within a pressure-resisting container to establish a space surrounding the casting mold within the container, the space surrounding the casting mold being in communication with the molding cavity of the mold;

sealing the pressure-resisting container;

actuating a plurality of clamping means into engagement with the outer faces of the mold parts to clamp the casting mold firmly;

feeding slip under a first pressure into the molding cavity of the casting mold until the latter is filled with the slip;

the water in the slip in the region of the inner molding surfaces of the molding parts partially oozing into the channels;

supplying a fluid under a second pressure higher than the first pressure into the space surrounding the casting mold and communicating with the molding cavity thereof, thereby to apply the second pressure to the slip with which the molding cavity has been filled and thus to the molding surfaces of the mold parts whereby further water of the slip in the region of the molding surfaces of the mold parts may ooze into the channels to form a cast layer of a predetermined thickness within the molding cavity of the casting mold;

depressurizing the channels to drain the water accumulated therein therethrough;

discharging the residual slip in the molding cavity of the mold therefrom; and removing the casting mold from the pressure-resisting container.

BRIEF DESCRIPTION OF THE DRAWINGS

Other objects, features and advantages of the present invention will become apparent from the following description when taken with reference to the accompanying drawings, in which.

DESCRIPTION OF THE PREFERRED EMBODIMENTS

Throughout the drawings, for ease of illustration, like elements are identified by like numerals.

Figure 1:
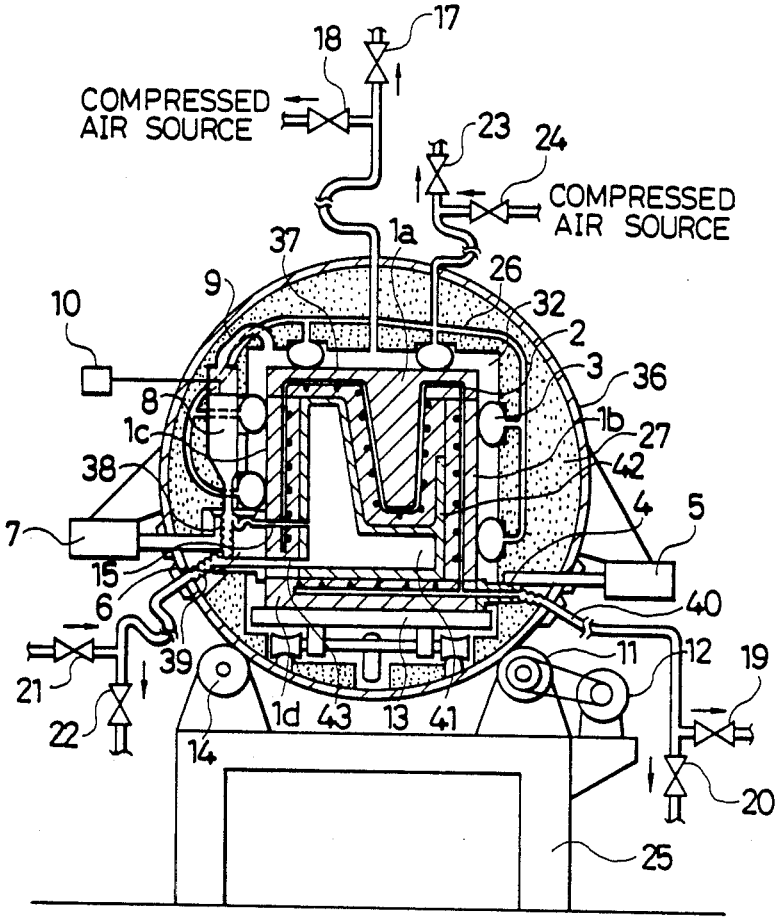
FIGS. 1 and 2 are a partially sectional view and a general perspective view, respectively, showing a casting installation for carrying out a casting process of one embodiment of the present invention.
Figure 2:
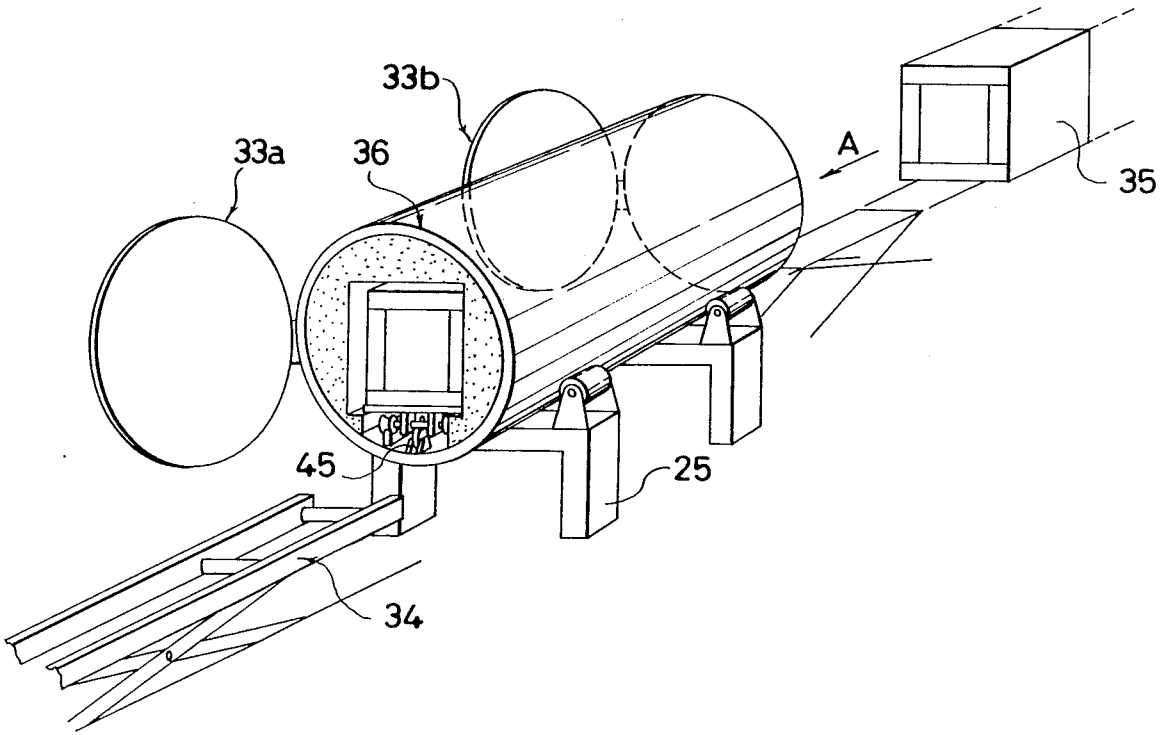

In FIGS. 1 and 2, there is shown a pressure-resisting container 36 preferably made of cylindrical shape in which are located a plurality of rectangular casting molds 1*a–d* (only one is shown in FIGS. 1 and 2) which are carried on carrier 13 which may include a roller conveyor, a chain conveyor or the like. The conveyor, if used, may be arranged to move through the pressure-resisting container 36 and to be provided thereon with pallets for supporting the casting molds 1.

The cylindrical pressure-resisting container 36 is supported for rotation about its longitudinal axis by two sets of rollers 11 and 14 placed on a base 25, one of which roller sets is associated with a motor/reducer unit 12. The controlling of the motor/reducer unit 12 causes the rollers 11 to rotate a predetermined number of turns, which allows the cylindrical container to rotate about its axis by an angle at which the casting molds 1 contained in the container are being brought into its slip discharging position. Accordingly, in other words, the motor/reducer unit 12 causes the casting molds 1 in the container 36 to angularly displace between their upright casting position and include slip discharging position through the rollers 11 and 14.

The casting mold 1 consists of a plurality of parts, of which four parts 1*a*, 1*b*, 1*c* and 1*d* are shown in section in FIG. 1. Each of these mold parts 1*a* to 1*d* is preferably of a porous material such as gypsum or other comparable porous material. Each mold part 1*a*, 1*b*, 1*c* or 1*d* has its respective outer face 37 sealingly covered with a resin or the like to prevent any fluid such as air or water from passing therethrough. As shown in FIG. 1, the mold part 1*a*, 1*b*, 1*c* or 1*d* is provided therein with passageways or channels 2 in the form of a hollow pipe arranged in a network pattern (only a portion is shown in FIG. 1). The channels 2 of each mold part also are arranged to communicate with one another and are adapted to be operatively connected to an in-mold pressure-releasing flexible tube 40 extending through a pad 4 which is brought into or out of engagement with the casting mold 1 by the action of a cylinder unit 5. The in-mold pressure-reducing flexible tube 40 also is opened on one hand to the atmosphere through a valve 19 and connected on the other hand to a pressure reducer (not shown) through a valve 20. Alternatively, the passageways 2 of each mold part may be made operatively independent of those of the adjacent mold parts and separately connected to the in-mold pressure-reducing flexible pipe 40.

Each of the casting molds 1 also has a slip admission and discharge port 43 at its respective bottom portion for admitting and discharging the slip therethrough. The slip discharge port 43 of each casting mold is adapted to be operatively connected to a casting and draining flexible tube 39 extending at one end portion through a pad 6 which comes into and out of contact with the casting mold through the action of a cylinder unit 7. The other end of the flexible tube 39 is connected on one hand through a casting valve 21 to a slip source (not shown) and leads on the other hand through a slip discharging valve 22 to a slip reservoir (not shown).

As shown, a surrounding wall 27 is formed in the pressure-resisting container 36 along the cylindrical inner surface thereof so as to define a hollow area which may be rectangular in section in which the casting molds 1 are located with a small space or gap 32 between the inner surface of the wall 27 and the casting molds 1. Preferably, the surrounding wall 27 is formed of light aggregates. The space 32 in the pressure-resisting container 36 is equipped in its selected areas with a plurality of separate inflatable air bladders 3 which can cooperate to clamp the casting molds 1 against their motion. The air bladders 3 are connected with one another via air passageways or conduits 26 which are provided in the surrounding wall 27. These air conduits 26 in turn are connected on one hand to a compressed air source (not shown) through an air feed valve 24 and on the other hand to the atmosphere through an air release valve 23.

In order to reduce the amount of the compressed air to be fed to the air bladders 3 for fully clamping the molds 1, it is advantageous to produce narrower space 32 between the surrounding wall 27 and the outer mold faces 37 for example, by making the surrounding wall 27 more massive within the container 36.

In the present embodiment, as described above, the mold clamping means is composed of the inflatable air bladders 3 which are arranged along the sides of the casting molds 1 in the space 32 in the pressure-resisting container 36. As an alternative to the clamping means, pneumatic or hydraulic cylinder clamp units may be disposed in the pressure-resisting container 36 to clamp the casting molds 1 therearound. On the other hand, rather than subjecting the molds 1 to a clamping operation within the pressure-resisting container 36 after insertion thereinto, the casting molds may be clamped by any suitable clamping means prior to introduction thereof into the container 36.

Further included in the inventive casting installation are one or more auxiliary slip supply reservoirs 8 which are disposed outside the casting molds 1 within the surrounding wall 27 of the pressure-resisting container 36. The auxiliary slip supply reservoir 8 is connected at the lower portion thereof to the casting and draining flexible tube 39 through a slip supply flexible tube 38 communicating with a mold cavity 41 via a conduit 15, and at its upper portion to the space 32 via an air conduit 9. With the arrangement described above, it should be noted that the pressure on the slip being cast and the pressure in the space 32 can be substantially equalized.

Figure 3:
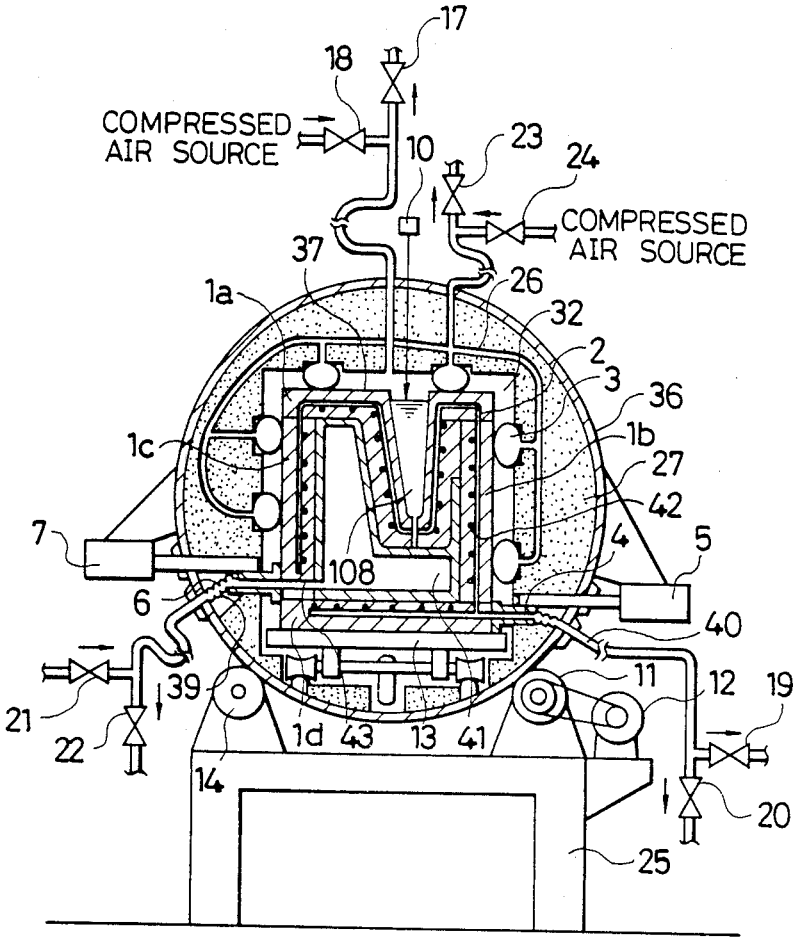
FIG. 3 is similar to FIG. 1, showing a modified casting installation.

Alternatively, it is possible to use as auxiliary slip supply means a longitudinal recess 108 provided either in any of the mold parts, e.g., 1*a*, of each mold as shown in FIG. 3. Otherwise, the auxiliary slip supply reservoir may be individually disposed outside of the pressure-resisting container 36.

A level controller 10 is associated with the slip supply reservoir 8 and controls the level of the slip within the mold during the casting operation.

In operation, the mold parts are set up to provide a plurality of casting molds 1, and then these molds 1 are conveyed successively one after another into the container 36 at the one end in the direction of arrow A as shown in FIG. 1 until a predetermined number of the molds 1 are disposed therein. The opening of an access door 33*b* at the introduction end of the pressure-resisting container 36 allows such introduction of the predetermined number of the molds 1 into the container 36. Although only one of the containers 36 is shown in FIG. 2, it is possible that a plurality of such containers 36 and their associated conveyor means and casting systems may be arranged in parallel side by side relationship so that similar operations may be performed simultaneously.

After introducing the predetermined number of casting molds 1 into that pressure-resisting container 36, the opposite doors 33*a* and 33*b* are closed to seal up the pressure-resisting container 36. The air release valve 23 is closed, and the air feed valve 24 is opened to causing the compressed air to flow from its source via the air conduit 26 into the air bladders 3 to thereby inflate the latter. Of course, the pressure of that compressed air is such as to be higher than that prevailing in the space 32. The individual air bladders 3 abut, when inflated, against the outer faces 37 of the casting molds 1 to clamp and fix them against movement thereof.

The cylinder 7 is actuated to bring the pad 6 into sealing engagement with the casting molds 1 and also to connect the casting and draining flexible tube 39 to the casting and discharging port 43. Simultaneously, the cylinder 5 at the side opposed to the cylinder 7 also is actuated to bring the pad 4 into sealing engagement with the casting molds 1 and to connect the in-mold pressure-reducing flexible tube 40 to the channels 2 in the mold parts of each mold. The slip discharging valve 22 is closed, and the slip feed valve 21 is opened to supply the slip typically under a pressure within the range of 0.1 to 20 $kg/cm^2$ from its source into the respective casting molds 1. The monitoring of the slip level in the casting molds 1 is performed by the level controller 10 associated with the supply reservoir 8, and the slip supply valve 21 is closed at the time when the slip in the supply reservoir 8 reaches a predetermined level.

Thereafter, the air release valve 17 is closed, and a compressed air feed valve 18 is opened to introduce the compressed air (normally under a pressure of 1 to 20 kg/cm$^2$) from its not shown source into the space 32 surrounding the casting molds 1. Since communication is being provided between the space 32 and the upper plenum of the slip supply reservoir 8, it is assured that the pressure in the space 32 is equal to that to be applied to the free surface of the slip in the auxiliary slip supply reservoir 8. Since, moreover, this slip supply reservoir 8 is in fluid communication with the mold cavity 41, the pressure on the slip free surface in the reservoir 8 is equal to that of the slip to be applied to the inner face of the casting mold 1. Accordingly, application of the common pressure to both the inner and outer faces of the casting molds 1 is achieved. Then, the water contained in the slip in the region of the molding surfaces of the casting mold 1 will exude or ooze out through the porous layers of the mold parts into the channels 2.

Next, with the air release valve 19 closed and the valve 20 opened, the pressure reducer connected to the valve 20 is actuated so that the pressure in the channels 2 in the mold parts 1*a*, 1*b*, 1*c* and 1*d* may be depressurized to drain the water collected therein to the outside of the casting molds 1 through the in-mold pressure-reducing flexible tube 40. In order to promote the oozing of the water content of the slip into the channels 2, the pressure reduction of the channels 2 of the mold parts may be performed simultaneously with the feed of the compressed air into the space 32.

When the slip is cast to a layer of a predetermined thickness 42 on the molding surfaces of each casting mold 1, the slip discharging valve 22 is opened with the casting valve 21 remaining closed. Next, the motor/reduction unit 12 is actuated to rotate the roller 11 a predetermined number of turns to turn the pressure-resisting container 36 a predetermined angle about its longitudinal axis. This also causes angular displacement of the casting molds from their casting position to their inclined discharge position, in which latter position the slip remaining in the casting mold 1, i.e., the slip having failed to form the cast layer 42 may be discharged from the respective molds 1 via their draining ports 43. When the slip in the supply reservoir 8 falls down to a predetermined level, the compressed air in the space 32 will flow into the mold cavity 41 via the feed conduit 15 to promote the discharge of the slip. The slip thus discharged from within the casting mold 1 and the supply reservoir 8 flows through the valve 22 into its reservoir, in which it is reserved for further use.

When this discharge is completed, the draining valve 22 is closed. Since, at this time, the compressed air feed valve 18 is still open, the compressed air successively coming from its source will further dehydrate the cast slip layer 42. After a predetermined period of time has elapsed, the compressed air feed valve 18 is closed, and the pressure resisting container 36 is returned to its initial position by the reverse operation of the motor/reduction unit 12. Next, the air release valve 17 is opened. Then, the space 32, the supply reservoir 8 and the mold cavities 41 all in the pressure-resisting container 36 are returned to the atmospheric state by releasing the residual compressed air to the atmosphere. Next, the cylinder 7 is actuated to bring the pad 6 out of contact with the casting mold 1. Simultaneously, the cylinder 5 is also actuated to bring the pad out of contact with the casting mold 1. After doing this, the air release valve 23 is opened to release the pressure in the air bladders 3 so that the casting molds 1 may be released from its clamped and set state, thereby completing the casting cycle.

In order to transfer the molds containing the castings to different stations for further processing of the castings, the molds can be removed from the container 36 by opening the door 33*a* of the container 36. To this end, a conveyor lifter 34 is available which may be located adjacent the pressure-resisting container 36 as shown in FIG. 2.

These stations may include those for feeding the setter, removing the castings from the molds, adhering, attaching an accessory mold, boring, rinsing the mold, setting the mold for further use and so on.

Conveniently, in removal of the molds 1 from the container 36, the door 33*b* is also opened and new casting molds can be inserted into the pressure-resisting container 36 while extracting the used casting molds therefrom. Thus, the casting cycle can be performed continuously.

Figure 4:
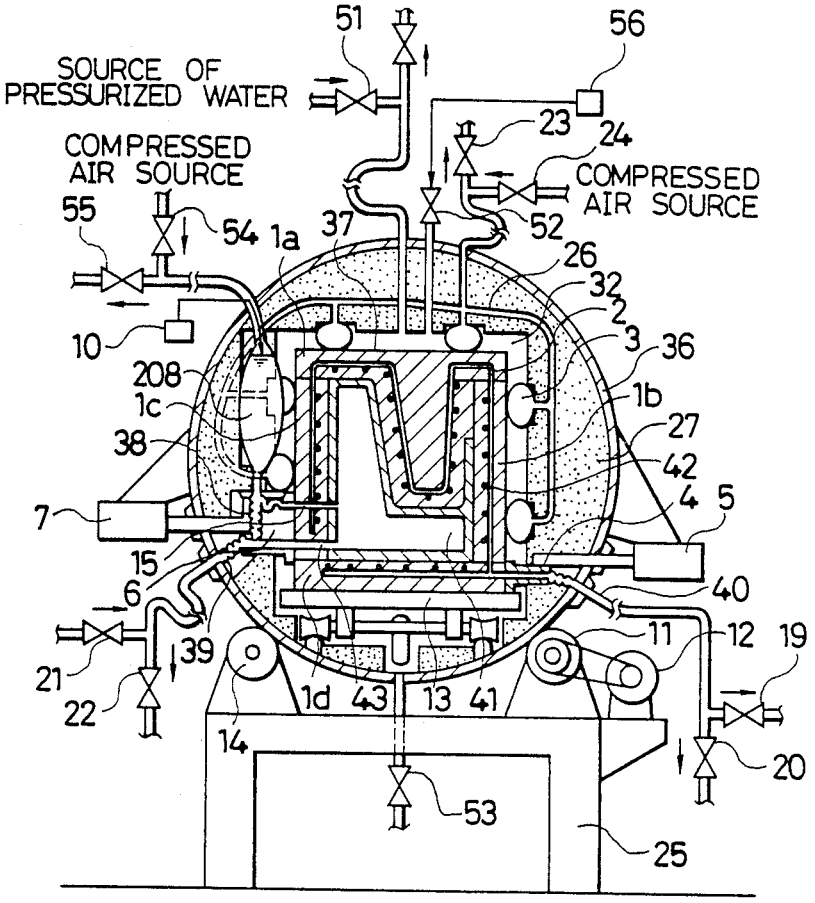
FIG. 4 is similar to FIGS. 1 and 3, showing another embodiment of the present invention.

Turning now to FIG. 4, a modified casting installation is shown which is similar to that shown in FIG. 1 except that an auxiliary slip supplying reservoir 208 is provided in an extended portion of the space 32 and is adapted to be connected through a valve 54 to a compressed air source and through an air release valve 55 to the atmosphere and that a space 32 is supplied with a pressurized water through a water feed valve 51.

The slip supply reservoir 208 can be made of a resilient material such as a rubber.

A level controller 56 is provided for detecting the level of the pressurized water at which the water overflows an air release valve 52 through which the space 32 communicates with the atmosphere.

Also, a water draining valve 53 is located underneath the pressure-resisting container 36 for allowing the pressurized water which has been fed into the space 32 to discharge.

The operation of the FIG. 4 apparatus is different from that of the apparatus described with reference to Figs. 1 and 3 in the following points.

After the slip feed valve 21 is closed, both of the air release and water draining valves 55 and 53 are closed and the pressurized water feed valve 51 is opened to introduce water under a pressure (normally 1 to 20 kg/cm$^2$) from its source (not shown) into the space 32 surrounding the casting molds 1. An air release valve 52 is closed as a level controller 56 detects the level of the pressurized water at which the water immediately overflows the valve 52. The elastic supply reservoir 208 is compressed by the pressure of the water so that the pressure in the space 32 balances the pressure of the slip in the supply reservoir 208, i.e., the pressure in the mold cavity 41.

When the slip is cast to a predetermined thickness 42 on the molding surface of each casting mold 1, the compressed air feed valve 54 is opened to introduce the compressed air (under the same pressure as of the pressure water).

Next, the slip discharge valve 22 is opened with the casting valve 21 remaining closed, and the motor/reduction unit 12 is actuated to rotate the roller 11 a predetermined number of turns to turn the pressure-resisting container 36 a predetermined angle about its axis so that the slip remaining in the casting molds 1, i.e., the slip having failed to form the cast layer 42 may be fully discharged out from the molds 1 via the respective discharging parts 43.

When the slip in the supply reservoir 8 falls down to a predetermined level, the compressed air will flow into the mold cavity 41 via the feed conduit 15 to promote the discharging of the slip.

The slip thus discharged from the casting molds 1 and the supply reservoir 8 flows through the valve 22 into its reservoir, in which it is reserved for further use.

When this discharge is completed, the draining valve 22 is closed.

Since, at this time, the compressed air feed valve 54 still remains open, the compressed air coming from its source will provide for further dehydration of the cast slip layer 42.

After a predetermined period of time has elapsed, the compressed air valve 54 is closed, and the pressure-resisting container 36 is returned to its initial state.

Next, the pressurized water feed valve 51 is closed and not only the air release valve 55 but also the water draining valve 53 and the air release valve 52 are opened to drain the water out of the space 32.

After doing this, the cylinders 7 and 5 are likewise actuated to bring the pads 6 and 4 out of contact with the casting mold 1, respectively. Then, the air release valve 23 is opened for release of the pressures in the air bladders 3 to complete the casting cycle.

As can be understood from the foregoing, the present invention employs the unique casting mold which is less heavy and bulky than in the prior art and which can withstand the same casting pressure of the slip to be fed to the mold as of the prior art. Likewise, the casting installation is light as well as highly durable. The casting efficiency can be two times as high as that of the prior art, and the cost for the facilities can be cut in half. This reduces the production cost for the casting mold to about one third as compared with the prior art.

Obviously, many modifications and variations of the present invention are possible in light of the above teachings. It is, therefore, to be understood that within the scope of the appended claims, the invention may be practiced in a manner other than as specifically described.

What is claimed is:

1. A process for casting slip into a ceramic product comprising the steps of:

providing at least one casting mold, said at least one casting mold comprising a plurality of separate porous mold parts, each of said mold parts having a fluid-tight outer face and an inner molding surface and having a plurality of channels therein, said mold parts being combined such that said inner molding surfaces of said mold parts define a molding cavity in said at least one casting mold;

positioning said at least one casting mold within a pressure container such that a space surrounding said at least one casting mold is established within said pressure container, said space being in fluid communication with said molding cavity of said at least one casting mold through an auxiliary slip supply reservoir means and a first opening in said mold which first opening leads into said molding cavity;

sealing said pressure container;

firmly clamping said at least one casting mold by bringing a plurality of clamping means into engagement with said outer faces of said mold parts;

feeding slip under a first pressure into said molding cavity of said at least one casting mold through a second opening in said mold which leads to said molding cavity until said molding cavity is filled with said slip, wherein water in said slip in the region of said inner molding surfaces of said mold parts partially oozes into said channels;

supplying a fluid under a second pressure higher than said first pressure into said space thereby applying said second pressure to slip within said auxiliary slip supply reservoir means and thereby to said slip within said molding cavity through said first opening and thus to said inner molding surfaces of said mold parts, whereby additional water from said slip in said region of said inner molding surfaces of said mold parts oozes into said channels to form a cast layer of predetermined thickness within said molding cavity of said at least one casting mold;

depressurizing said channels to drain said water accumulated therein;

discharging residual slip from said molding cavity of said at least one casting mold; and removing said at least one casting mold from said pressure container.

2. A process according to claim 1, wherein said at least one casting mold is clamped by clamping means comprising a plurality of inflatable air bladders located in said space.

3. A process according to claim 1, wherein said at least one casting mold is clamped by clamping means comprising pneumatic or hydraulic cylinder clamp units.

4. A process according to claim 1 wherein said fluid supplied to said space comprises compressed air.

5. A process according to claim 1, wherein said fluid supplied to said space comprises pressurized water.

6. A process according to claim 1, wherein said at least one casting mold is clamped prior to being positioned within said pressure container.

7. A process according to claim 6, wherein said at least one casting mold is clamped by clamping means comprising pneumatic or hydraulic cylinder clamp units.

8. A process according to claim 1, wherein during said supplying of said fluid said second pressure into said space, additional slip is supplied into from said molding cavity auxiliary slip supply reservoir means associated with said space said.

9. A process according to claim 8, wherein said auxiliary slip supply reservoir means is located in said pressure container.

10. A process according to claim 8, wherein said auxiliary slip supply reservoir means comprises a recess in said at least one casting mold.

* * * * *